US007792463B2

(12) United States Patent
Sakagawa et al.

(10) Patent No.: US 7,792,463 B2
(45) Date of Patent: Sep. 7, 2010

(54) IMAGE FORMING APPARATUS INCLUDING A BRUSH MEMBER TO TEMPORARILY CAPTURE TONER

(75) Inventors: Yoshio Sakagawa, Ashiya (JP); Tetsumaru Fujita, Nishinomiya (JP); Yuji Nagatomo, Minoo (JP)

(73) Assignee: Ricoh Company, Limited, Tokyo (JP)

( * ) Notice: Subject to any disclaimer, the term of this patent is extended or adjusted under 35 U.S.C. 154(b) by 17 days.

(21) Appl. No.: 12/050,529

(22) Filed: Mar. 18, 2008

(65) Prior Publication Data

US 2008/0232875 A1 Sep. 25, 2008

(30) Foreign Application Priority Data

Mar. 19, 2007 (JP) ..... 2007-070572

(51) Int. Cl.
*G03G 15/30* (2006.01)

(52) U.S. Cl. ..... 399/149; 399/50; 399/176

(58) Field of Classification Search ..... 399/34, 399/71, 149, 354, 150, 35
See application file for complete search history.

(56) References Cited

U.S. PATENT DOCUMENTS

| | | | | |
|---|---|---|---|---|
| 2005/0036805 | A1* | 2/2005 | Murakami et al. | 399/149 |
| 2007/0059007 | A1* | 3/2007 | Ai | 399/49 |
| 2007/0065179 | A1 | 3/2007 | Fujita | |
| 2007/0172259 | A1 | 7/2007 | Fujita | |
| 2007/0280735 | A1 | 12/2007 | Nagatomo et al. | |

FOREIGN PATENT DOCUMENTS

| | | | |
|---|---|---|---|
| JP | 59033467 | * | 2/1984 |
| JP | 2004-170530 | | 6/2004 |

* cited by examiner

*Primary Examiner*—David M Gray
*Assistant Examiner*—Roy Yi
(74) *Attorney, Agent, or Firm*—Oblon, Spivak, McClelland, Maier & Neustadt, L.L.P.

(57) ABSTRACT

A brush member includes plural raisings and contacts a surface of an image bearer downstream of a transfer station and temporary captures toner remaining on the surface of the image bearer into the brush member in a toner capturing process. The brush member returns the toner to the surface of the image bearer at a prescribed time in a toner returning process. A bending direction of the plural raisings is opposite in the returning process to that in the toner capturing process.

14 Claims, 10 Drawing Sheets

IMAGE FORMING APPARATUS INCLUDING A BRUSH MEMBER TO TEMPORARILY CAPTURE TONER

CROSS REFERENCE TO RELATED APPLICATION

This application claims priority under 35 USC §119 to Japanese Patent Application No. 2007-070572, filed on Mar. 19, 2007, the entire contents of which are herein incorporated by reference.

BACKGROUND OF THE INVENTION

1. Field of the Invention

The present invention relates to an image forming apparatus, such as a printer, a copier, a facsimile, etc., capable of temporarily capturing toner adhering to a surface of an image bearer into a blush after a transfer step, and capable of returning the toner to the surface of the image bearer from the blush at a prescribed time.

2. Discussion of the Background Art

In a conventional image forming apparatus that employs an electro-photographic system, an image is formed in a process as described below. That is, exposure scanning is applied to an image bearer, such as a photoconductive member, etc., uniformly charged by a charging apparatus with electricity, and a latent image is formed thereon. A developing apparatus then develops the latent image. A toner image thus obtained by development is transferred from the image bearer to a printing member such as a printing sheet either directly or via an intermediate transfer member. In such a process, toner not transferred either onto the printing member or the intermediate transfer member adheres to the surface of the image bearer as post transfer toner after the transfer process is completed. A cleaning recycle mechanism is then sometimes employed to remove the post transfer toner from the image bearer using a cleaning blade, and conveys the toner to the developing apparatus to recycle the same.

However, since this type of a cleaning recycle mechanism necessitates a toner conveyance mechanism for conveying the post transfer toner scraped from the surface of the image bearer to the developing apparatus, the image forming apparatus becomes complicated and balky.

As an image forming apparatus capable of handling post transfer toner without a cleaning recycle mechanism, a technology of temporarily capturing post transfer toner with a blush member is known as described in Japanese Patent Application Laid Open No. 2004-170530. This type of image forming apparatus executes a temporary capturing process capable of temporally capturing post transfer toner scraped off from the surface of the image bearer with a blush member. Then, the image forming apparatus executes a returning process for returning the toner from the brush to the surface of the image bearer while changing a bias condition at a prescribed time such as when a print job is completed. Then, by transferring the toner into a developer carrier such as a developing roller arranged in a developing apparatus from the surface of the image bearer, the post transfer toner is finally collected within the developing apparatus. Since a complicated toner transfer mechanism such as a conveyance screw, a conveyance belt, etc., is not needed in such a configuration, the image forming apparatus can be downsized at low cost.

However, in this type of image forming apparatus, toner is gradually accumulated in the brush as long time elapses. As a result, an abnormal image is sometimes created. Specifically, toner scraped off from the surface of the image bearer by a brush having a plurality of raisings is taken in between raisings in the brush. Specifically, almost all of the toner taken in generally stays at a tip of the brush, and then smoothly returns to the surface of the image bearer in a returning process. However, there exists some toner deeply entering the brush owing to the influence of behavior of the brush after being taken in the brush.

Such toner can't smoothly move to the tip of the brush for the below-described reasons. Specifically, in the returning process, an electric flux line created at a contact section between the brush and the image bearer extends almost straight along a vertical line in relation to the surface of the image bearer. In contrast, the raising contacting the surface of the image bearer is bent following the moving surface of the image bearer. The toner deeply staying in the brush between the raisings collide with a side surface of the raising bending in a direction when moving straight along the electric flux line. Thus, the toner can't smoothly move to the tip.

For the above-mentioned reasons, toner is gradually accumulated on the root side of the brush as time elapses. Later on, an abnormal image is created for variety of causes.

For example, when a brush member is used to double as a charging member for uniformly charging the surface of the image bearer, the toner accumulated in the brush makes discharge unstable between the brush and the image bearer, thereby creating uneven charge. As a result, an abnormal image such as uneven density is created.

When a lot of toner is accumulated in the brush, the mass of toner is inversely transferred back to the image bearer in a block even though temporal capturing is on the way due to influence of the behavior of the brush. Then, the toner prevent uniform discharging of an image bearer during a later exposure step, thereby, uneven discharge or write error is caused on the image bearer in the latent image writing step.

SUMMARY OF THE INVENTION

Accordingly, an object of the present invention is to improve such background arts technologies and provides a new and novel image forming apparatus. Such a new and novel image forming apparatus comprises a brush member. The brush member includes plural raisings and contacts a surface of an image bearer downstream of a transfer station and temporary captures toner remaining on the surface of the image bearer into the brush member in a toner capturing process. The brush member returns the toner to the surface of the image bearer at a prescribed time in a toner returning process. A bending direction of the plural raisings is opposite in the returning process to that in the toner capturing process.

In another embodiment, an electric field direction changing device changes a direction of an electric field created between the brush member and the image bearer. The temporal capturing process is switched to the returning process in accordance with the direction of the electric field.

In yet another embodiment, the electric field direction changing device creates an alternating electric field in the returning process.

In yet another embodiment, the returning process is executed when a blank region of the surface of the image bearer passes through the brush member.

In yet another embodiment, the brush member includes a rotary shaft member rotatively supported by a supporting member, a brush roller having the plural raisings around its outer circumferential surface, and a driving member that drives the brush roller.

In yet another embodiment, the bending direction of the plural raisings is changed by changing a difference between a line speed of the image bearer and that of the brush member when the returning process is executed from when the temporal toner capturing process is executed.

In yet another embodiment, the returning process is executed while the brush roller is driven at the line speed less than a half of the surface moving speed of the image bearer.

In yet another embodiment, the brush member includes a flat supporting member, and the plural raisings protrude from the surface of the flat supporting member.

In yet another embodiment, a brush shifting device is provided to shift the brush member. The bending direction of the plural raisings is changed by shifting the brush member located at an original position in a prescribed direction when the returning process is executed. The brush member is located at the original position when the temporal toner capturing process is executed.

In yet another embodiment, the surface of the image bearer moves along a circular arc orbit at a contact with the brush member, and the plural raisings bend along the circular arc orbit.

In yet another embodiment, the bending direction of the plural raisings in the returning process is changed from that in the temporal toner capturing process by moving the surface of the image bearer in an opposite direction to that in the temporal toner capturing process.

In yet another embodiment, a break in amount changing device is provided to change an amount of breaking in of the brush member to the image bearer. The amount is more increased when the returning process is executed than when the temporal toner capturing process is executed.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
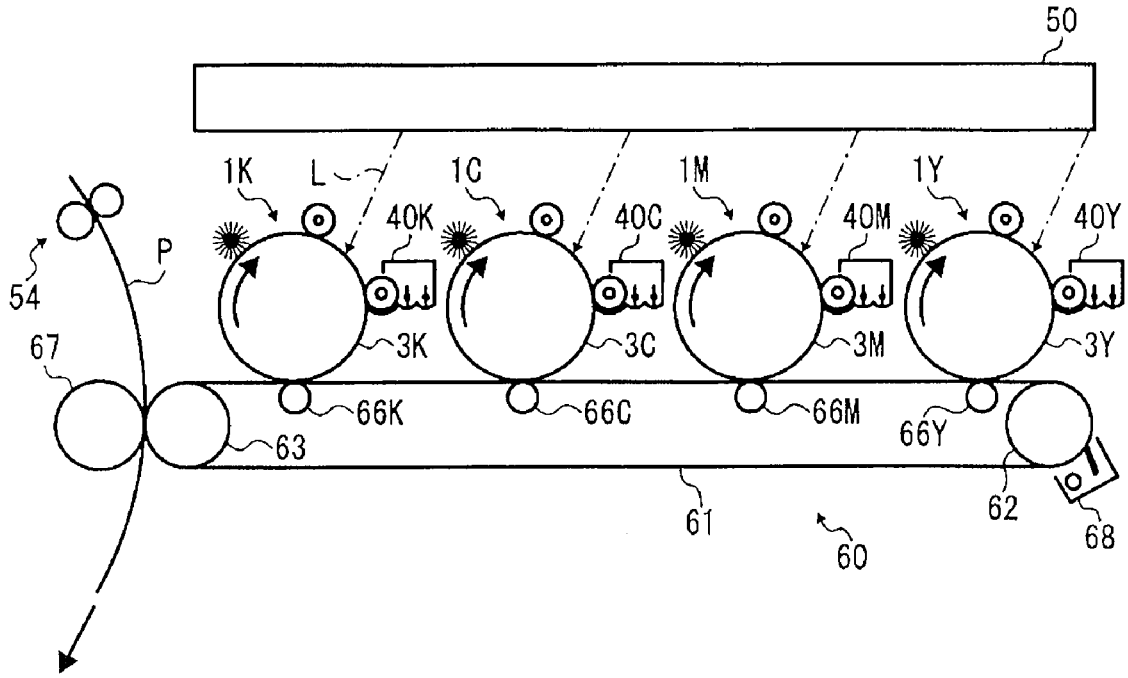
FIG. 1 illustrates an exemplary printer according to one embodiment of the present invention.

Referring now to the drawing, wherein like reference numerals designate identical or corresponding parts throughout several views, in particular in FIG. 1, an exemplary laser printer (wherein after simply referred to as a printer) as an image forming apparatus that employs an electro-photographic system is described. Initially, a fundamental configuration of the printer according to the present invention is described. As there shown, the printer includes four process units 1Y to 1K for forming toner images of yellow, magenta, cyan, and black (Y, M, C, K), respectively. An optical unit 50, a pair of registration rollers 54, and a transfer unit 60 or the like are provided. Suffixes Y to K assigned to respective numbers represent members for yellow to black uses, respectively.

The optical writing unit 50 serving as a latent image formation device includes a light source formed from four laser diodes corresponding to respective colors Y to K, a cubical polygon mirror, a polygon motor for driving the cubical polygon mirror, a F-theta lens, a lens group, a reflection mirror or the like. A laser light L ejected from the laser diode arrives at any one of four photoconductive members as mentioned later in detail after being reflected and deviated by one of surfaces of the polygon mirror. Respective laser lights L ejected from the four laser diodes optically provides scanning to the surfaces of the four photoconductive members Y to K, respectively.

The process units 1Y to 1K include drum type photoconductive members 3Y to 3K serving as latent image carriers and developing devices 40Y to 40K, respectively. Each of the photo-conductive members 3Y to 3K is formed from a bear tube made of metal such as aluminum wrapped with an organic photoconductive layer, and is driven clockwise by a driving device, not shown, at a prescribed line speed. Then, the photoconductive members receive optical scanning in a dark from the optical writing unit 50 that emits laser lights L modulated in accordance with image information transmitted from a personal computer or the like, not shown, thereby carrying latent images for Y to K uses.

Figure 2:
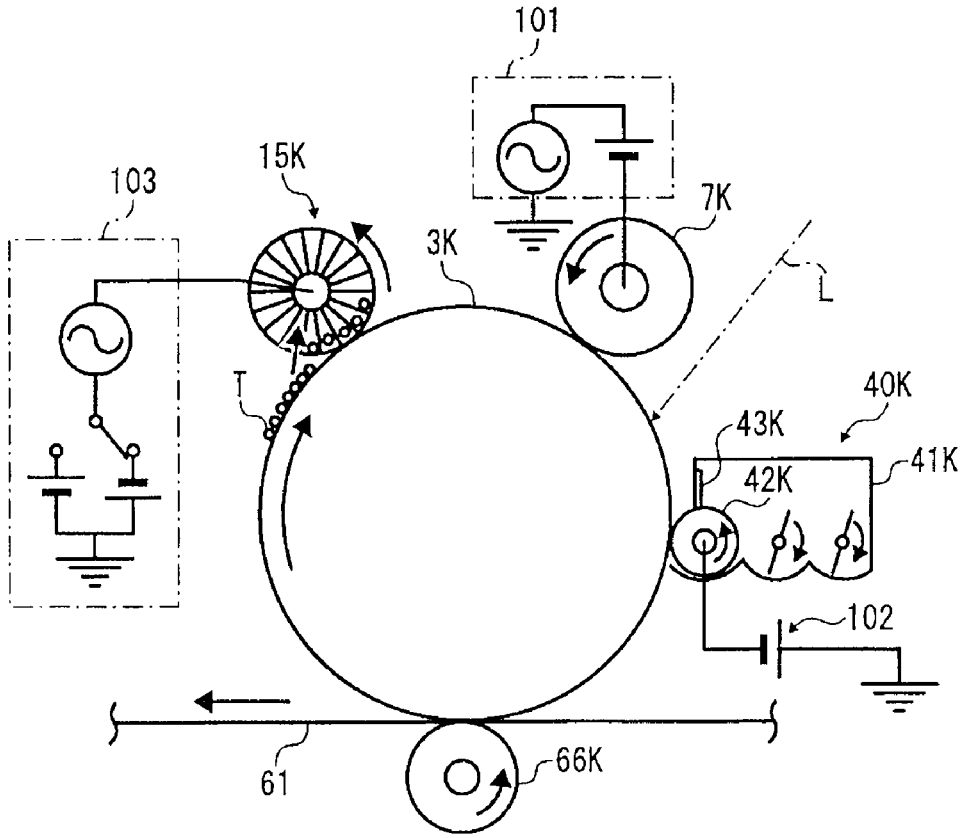
FIG. 2 illustrates an exemplary process unit for black color use included in the printer of FIG. 1.

As shown in FIG. 2, a process unit 1K includes a photoconductive member 3K, a discharge roller 7K, and a charge removing lamp, not shown. Also included in the process unit 1K are a toner capturing brush roller 15K serving as a brush member and a developing apparatus 40K or the like. These devices form a unit held by a common unit casing. Thus, the process unit 1K is detachable from a printer body.

The photoconductive member 3K is formed from a conductive substrate of an aluminum bear tube wrapped with a photoconductive layer including an organic optical conductive substance (opc) having a negative charge performance. A diameter of the photoconductive member 3K is about 24 mm, and is driven clockwise by a driving device, not shown, at a prescribed line speed as mentioned above.

The charge roller 7K includes a rotary shaft member made of metal wrapped with a conductive roller material such as rubber. The charge roller 7K is driven counterclockwise by a driving device, not shown, around the rotary shaft member as a rotary center and contacts and forms a nip with the photoconductive member 3K. A charging power supply 101 provides a charge bias to the rotary shaft member. When discharge occurs between the charge roller 7K and the photoconductive member 3K, the surface of the photoconductive member 3K is uniformly charged with a negative polarity.

When the optical writing unit 50 optically scans the surface of the photoconductive member 3K having the uniform charge, a latent image for black use is formed with a negative polarity having a lower potential than a background. The latent image is developed into a black tone image by the developing apparatus 40K.

The developing apparatus 40K includes a developing roller 42K partially exposed through an opening arranged on a casing 41K. The developing roller 42K rotates while carrying black toner on its periphery, not shown, stored in the casing 4K. The black toner carried on the surface of the developing roller 42K is conveyed to a developing region in which the developing roller 42K opposes or contacts the photoconductive member 3K as the developing roller 42K rotates.

A developing potential operates in the developing region between the developing roller 42K that receives the developing bias in the negative polarity from a developing power supply 102 and the latent image on the photo-conductive member 3K so as to electro-statically move the black toner in the negative polarity from the roller side to the latent image side. Further, a non-developing potential operates between the developing roller 42K and the uniformly charged portion (i.e., a background) of the photoconductive member 3Y so as to electro-statically move the black toner in the negative polarity from the background side to the roller side. The black toner on the developing roller 42K is transferred to the latent image on the photoconductive member 3K while separating from the roller under the influence of the developing potential. With this transition, the latent image on the photoconductive member 3K is developed into a black toner image. The black toner image is transferred as a primary transfer onto an intermediate transfer belt 61 arranged in a transfer unit as mentioned later in detail.

A toner capturing brush roller 15K contacts and creates a capturing nip on the surface of the photoconductive member 3K at a section downstream of a primary transfer nip and upstream of either a contact position contacting the charge roller 7K or the developing region. The toner capturing brush roller 15K includes a rotary shaft member made of metal freely rotatively supported by a bearing, not shown, and a brush having a plurality of raisings made of conductive member protruding from the circumferential surface of the rotary shaft member. The toner capturing brush roller 15K is rotated counterclockwise with a tip of its brush contacting the photoconductive member 3K.

A collection power supply 103 supplies a bias to the rotary shaft member of the toner capturing brush roller 15K. The collection power supply 103 is enabled to change the bias.

Due to influence of transfer current at the primary transfer nip, the potential of the surface of the photoconductive member 3K passing through the first transfer nip decreases down to about zero to about −20 v, and post transfer toner adheres to the surface thereof. The collection power supply 103 supplies a capturing bias including superimposition of an alternating current voltage and a direct current voltage having a positive polarity to the toner capturing brush roller 15K when a region of the surface carrying the toner image on the photo-conductive member 3K passes through the contact portion contacting the toner capturing brush roller 15K. The post transfer toner slightly charged in a negative polarity (an normal charge polarity of toner) is attracted by a direct current component having a positive polarity in the brush, and is taken into the brush from the photoconductive member 3K. Specifically, when the collection power supply 103 supplies the capturing bias to the toner capturing brush roller 15K in this printer, a temporal capturing process is executed for temporarily capturing the post transfer toner adhering to the photoconductive member 3K into the brush formed from the plurality of raisings.

Figure 3:
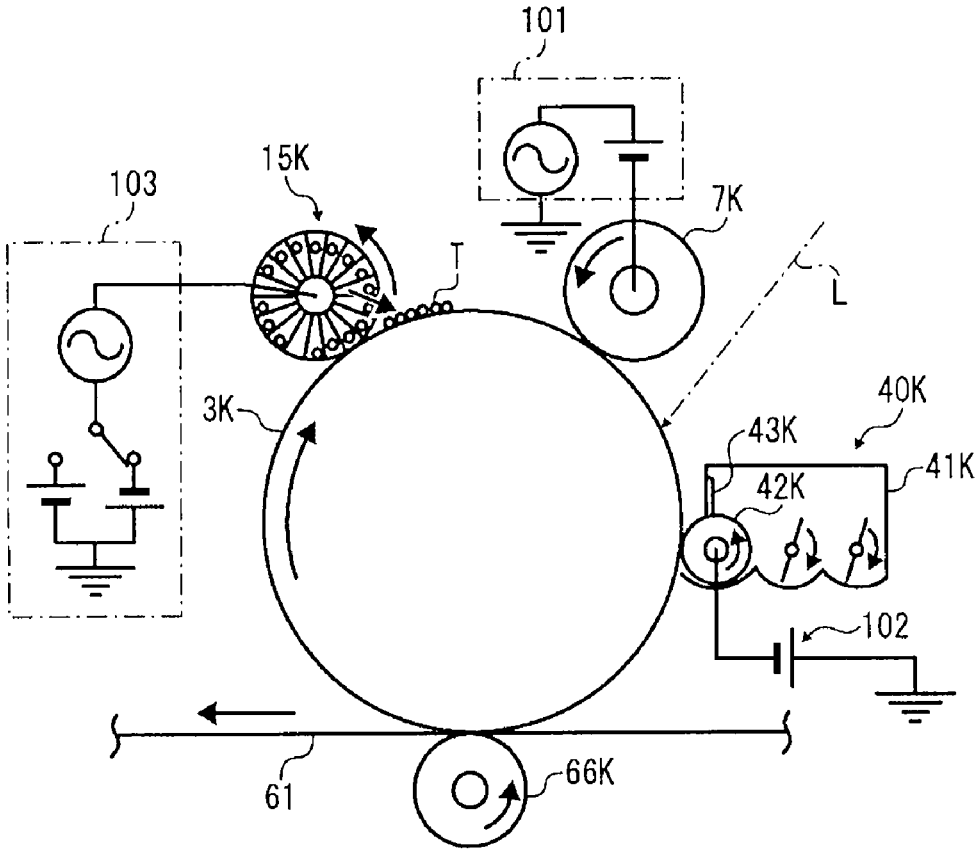
FIG. 3 illustrates an exemplary operation of a returning process executed by the process unit of FIG. 2.

The collection power supply 103 executes a returning process when the surface of the photoconductive member 3K not carrying a toner image passes through the contact position contacting the toner capturing brush roller 15K. For example, the returning process is executed when a printing job is completed or during a time corresponding to an interval of sheets successively fed. Specifically, as shown in FIG. 3, an ejection bias having superposition of an alternating current voltage and a direct current voltage having a negative polarity is applied to the toner capturing brush roller 15K. Thus, the post transfer toner with negative polarity reacts against the negative polarity of the brush and is reversely transferred from the brush back to the surface of the photoconductive member 3K. At this moment, the developing power supply 102 connects the developing roller 42*k* to ground. The toner returned to the surface of the photoconductive member 3K by the reverse transfer is transferred from the photoconductive member 3*k* to the developing roller 42K at the developing region and is then collected by the developing apparatus 40K.

The other process units 1Y to 1C have the same configuration and operate substantially in the same manner as the black use process unit 1K.

Referring back to FIG. 1, a transfer unit 60 is arranged below each of the respective process units 1Y to 1K and includes an endless belt wound around a plurality of suspension rollers and driven counterclockwise as an intermediate transfer belt 61. The plurality of suspension rollers includes a driven roller 62, a driving roller 63, and four first transfer bias rollers 66Y to 66K, and the like.

Each of the driven, first transfer bias, and driving rollers 62, 66Y to 66K, and 63 contacts the rear surface (i.e., the loop internal circumferential surface) of the intermediate transfer belt 61. The four primary transfer bias rollers 66Y to 66K include core metals wrapped with elastic member such as sponge and are biased toward the photoconductive members 3*y* to 3*k* for respective colors Y to K, thereby breaking into the intermediate transfer belt 61. Thus, four primary transfer nips having a prescribed length are formed for respective colors Y to K in the belt movement direction where the four photoconductive members 3Y to 3K and the intermediate transfer belt 61 contact each other.

A transfer bias power supply, not shown, supplies a primary transfer bias to the metals of the respective four primary transfer bias rollers 66*y* to 66K under constant current control. Thus, the transfer electricity is applied to the rear side of the intermediate transfer belt 61 via the four primary transfer bias rollers 66*y* to 66K, thereby a transfer electric filed is formed at each of the respective transfer nips between the intermediate transfer belt 61 and the photoconductive members 3Y to 3K. Although the primary transfer bias rollers 66Y to 66K are employed in this printer, brushes or blades or the like can be employed instead of the rollers. Transfer chargers can also be employed.

The respective toner images of mono colors Y to K formed on the photoconductive members 3Y to 3K are transferred and superimposed at the respective primary transfer nips onto the intermediate transfer belt 61. Thus, a toner image of four-color superimposition (herein after referred to as four color toner images) is formed on the intermediate transfer belt 61.

A secondary transfer bias roller 67 contacts the surface of the intermediate transfer belt 61 suspended by the driving roller 63 at a suspending position thereof, thereby a secondary transfer nip is formed. A voltage applying device, not shown, including a power supply and wiring supplies a secondary transfer bias to the secondary transfer bias roller 67. Thus, a secondary transfer electric field is formed between the secondary transfer bias roller 67 and a secondary transfer nip backside roller 64 grounded. The four color toner images formed on the intermediate transfer belt 61 enter the secondary transfer nip as the endless belt 61 travels.

The printer includes a sheet cassette, not shown, accommodating a plurality of printing sheets P in a bundle state. The top most printing sheet P is launched to a sheet passage at a prescribed time. The printing sheet P is then pinched by a registration nip formed between a pair of registration rollers 54 arranged at the end of the sheet passage.

The pair of registration rollers 54 rotates to convey the printing sheet P. However, the registration rollers 54 immediately stop rotating when pinching the tip of the printing sheet P. Then, the registration rollers 54 launches the printing sheet P in synchronism with the four color toner images on the intermediate transfer belt 61 toward the secondary transfer nip. At the secondary transfer nip, the four color toner images are subjected to the secondary transfer and are transferred onto the printing sheet P at once, thereby a full color toner image is formed on the white printing sheet P.

After that, the full-color image on the printing sheet P is ejected from the secondary transfer nip, and is fixed by a fixing apparatus, not shown.

The post transfer toner adhering to the surface of the intermediate transfer belt 61 even after passing through the secondary transfer nip is removed from the surface thereof by a belt cleaning apparatus 68.

Thus, the four process units 1Y to 1K and the optical writing unit or the like collectively serve as an image formation device for forming a toner image on the surface of the photoconductive member as an image bearer in the above-mentioned printer having the fundamental configuration. Further, the toner capturing brush roller 15K of FIG. 2 and the collection power supply 103 or the like collectively serves as a toner temporal capturing device for temporarily capturing and returning toner.

Figure 4:
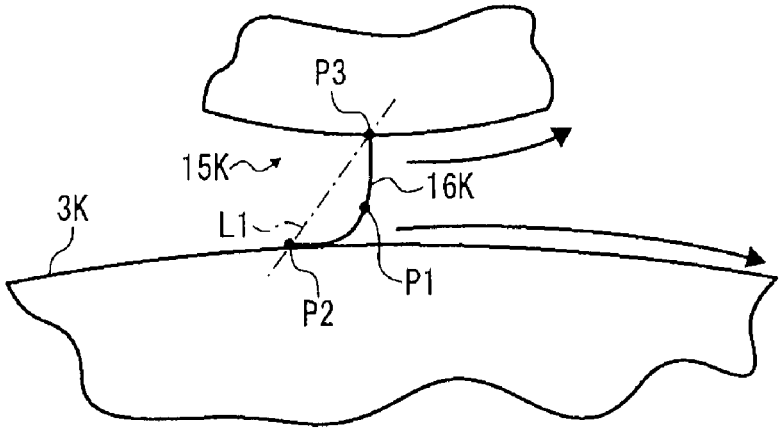
FIG. 4 illustrates an exemplary model showing posture of raising when a temporal capturing process is executed.
Figure 5:
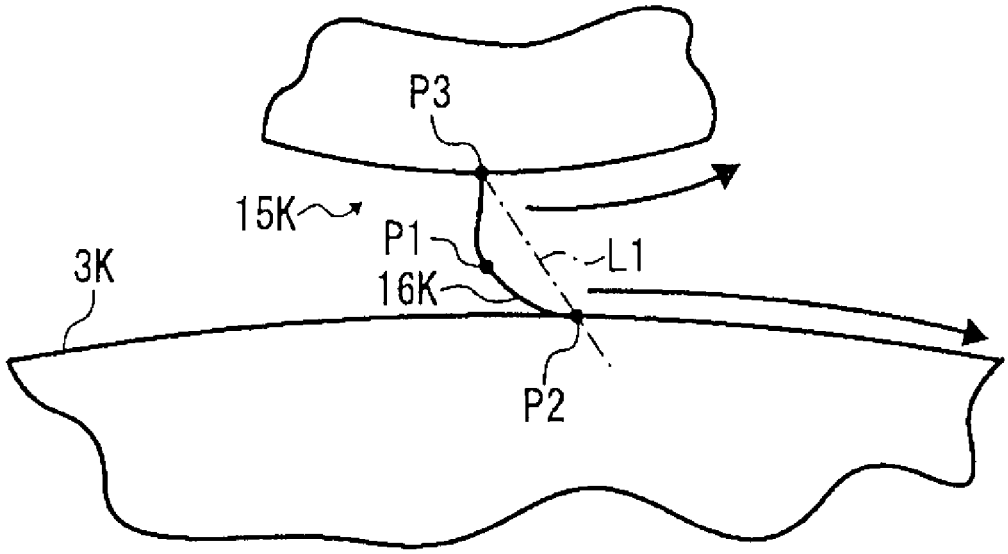
FIG. 5 illustrates an exemplary model showing posture of a raising when a returning process is executed.
Figure 6:
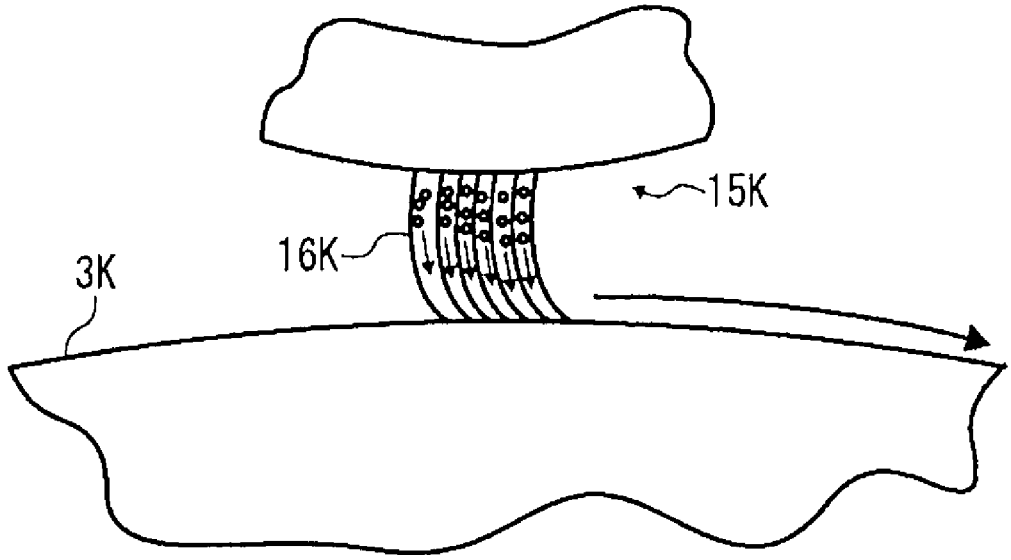
FIG. 6 illustrates an exemplary model showing posture of plural raisings in the middle of reversing its bending direction.

Now, a feature of this printer is described with reference to FIG. 4. In the above-mentioned returning process, the bending direction of the raising contacting the photoconductive member 3K is at least temporarily controlled to be opposite to that in the toner temporal capturing process. Specifically, the raising 16K is bent during the temporal capturing process such that the tip of the raising 16K is positioned more upstream of the photoconductive member 3K than the other end thereof. More specifically, the raising 16K is bent toward downstream of the surface moving direction so that a central point P1 of the raising positions more downstream than a hypothetical straight line extending through a leading end point P2 and the other end point P3. Whereas, when the returning process is executed, the raising 16K is at least temporarily bent in the opposite direction to that during the temporal capturing process as shown in FIG. 5. More specifically, the raising 16K is bent toward the upstream of the surface moving direction, so that the central point P1 can position upstream of the surface moving direction.

In such a returning process, before bending in the opposite direction, the center of the raising 16K positions on a vertical line extended from the surface of the photoconductive member. Since the raising at this moment is almost in parallel to the electric flux line created between the brush and the photoconductive member 3K, toner particle T deeply entering the brush smoothly moves toward the tip along the electric flux line. In addition, the toner particle T adhering to the raising 16K can be shaken off. Thus, this promotes the smooth movement of the toner particle T to the tip. Owing to that, the toner deeply entering the brush is promptly returned to the photoconductive member 3K in the returning process, accumulation of massive toner in the brush can be prevented.

As the ejection bias applied to the toner capturing brush roller 15K in the returning process, a superimposition bias including either an alternating current voltage or a superimposition of alternate and direct current voltages is preferably employed. Because, switching of a bias polarity due to the alternating current causes vibration of the toner particle T and more promotes separation thereof from the surface of the raising 16K. As a result, the toner particle T smoothly moves to the tip side.

Further, the returning process is preferably executed when a non-image region of the photoconductive member 3K passes through the brush. Because, toner put on the non-image region does not deteriorate an image quality.

Although the process unit 1K is typically described, the other color process units 1Y to 1C have the substantially the same configuration and can operate in the same way.

Now, several experiments are described. A first experiment is initially described. A printer-testing machine as illustrated in FIGS. 1 and 2 is prepared. Then, a thousand of monochrome test images are successively outputted on printing sheets under the following conditions:

Line speed of a photoconductive member: 100 mm/sec;

Rotary direction of a toner capturing brush roller during a temporary capturing process:

Forward rotary direction (i.e., a brush surface moves in the same direction as a surface of a photo-conductive member at a contact position contacting the photoconductive member);

Line speed of a toner capturing brush roller during a temporary capturing process: 100 mm/sec;

Direct current voltage of collection bias during a temporary capturing process: +300 V;

Alternating current voltage of collection bias during a temporary capturing process;

Peak to peak voltage: 1 Kv, Duty: 45%, and Frequency and Waveform: Rectangular Wave of 300 Hz;

Time of a returning process: 10 sec (while temporarily interrupting consecutive printing every three prints).

Rotary direction of a toner capturing brush roller during a returning processing:

Forward rotary direction;

Line speed of a toner capturing brush roller during a returning process: 100 mm/sec;

Direct current voltage of collection bias during a returning process: −500 V; and Alternating current voltage of collection bias during a returning process;

Peak to peak voltage; 1 kv, Duty: 45%, and Frequency and Waveform: Rectangular wave of 300 Hz.

In this experiment, the toner capturing brush roller is rotated at the same speed in the returning and the temporary capturing processes. Thus, the bending direction of the raising is not reversed in the returning process. Under these conditions, when a thousand of printings are made, an abnormal image is created due to accumulation of toner in the brush in the latter part of the printings.

Second experiment is now described.

A printing operation is successively executed in the same manner as in the first experiment except that the toner capturing brush roller is rotated at a half line speed (e.g. 50 mm/sec) of that of the photoconductive member. Even though a thousand of printings have been executed, an abnormal image is not created. Thus, it is evidenced that accumulation of toner in the brush can efficiently be suppressed if the bending direction of the raising is controlled in the returning process to be opposite to that in the temporal toner capturing process.

A third experiment is now described.

Figure 19:
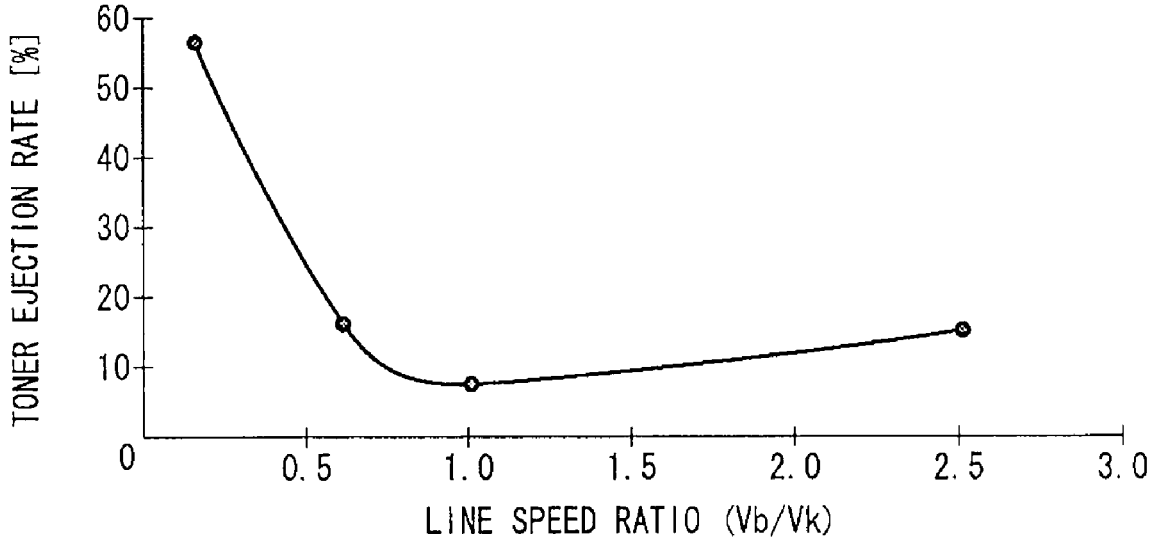
FIG. 19 illustrates an exemplary relation between a toner ejection rate and a line velocity ratio.

A thousand of successive printings are executed as in the second experiment while optionally changing a line speed Vb of the toner capturing brush roller and that Vk (i.e., a surface moving speed) of the photoconductive member in the returning process. Then, a weight of the toner capturing brush roller in an initial state and that after successive printings are measured after the successive printings are completed. Based on the measurement, a rate of the toner ejected from the brush is calculated. It is found that when a ratio of lime speeds Vb/Vk is gradually decreased down to around 0.5, the rate sharply increases as shown in FIG. 19.

Then, a returning process is preferably executed while the toner capturing brush roller is rotated at a driving speed so that the line speed Vb is less than the half of the line speed Vk of the photoconductive member.

Fourth experiment is now described.

Figure 20:
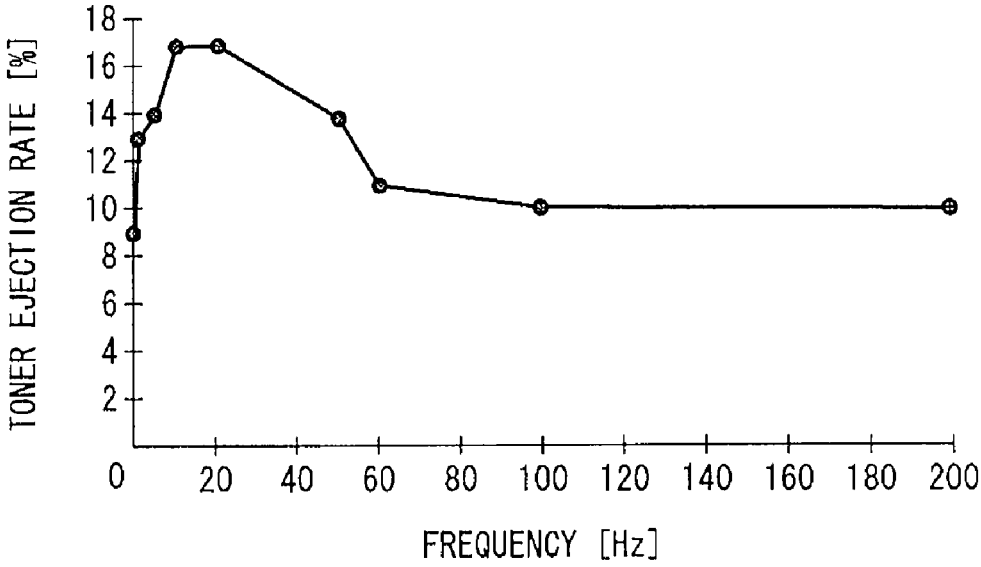
FIG. 20 illustrates an exemplary relation between a toner ejection rate and a frequency of an alternating current voltage.

A thousand of successive printings are executed as in the second experiment while appropriately changing a frequency of an alternating current voltage of the collection bias in the returning process. Then, a rate of toner ejected from the brush is calculated in the same manner as in the third experiment. Then, it is found that when the frequency is gradually decreased down to around 50 Hz, the rate sharply increases as shown in FIG. 20.

Then, a returning process is preferably executed with the frequency of the collection bias less than 50 Hz.

Figure 7:
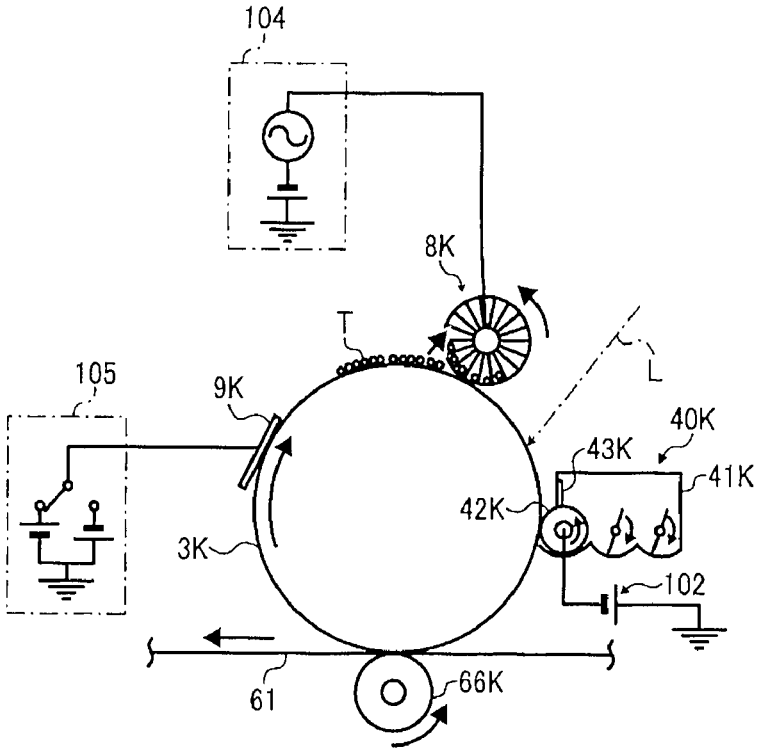
FIG. 7 illustrates an exemplary process unit for black color use as a first modification of the printer according to the present invention.

Now, various modifications of the printer according to this embodiment are described. The first modification is initially described with reference to FIG. 7. This process unit 1K employs a charge brush roller 8K instead of the charge roller 7K of FIG. 2. The charge brush roller 8K includes a rotary shaft member made of metal freely supported by a bearing, not shown, and a brush having a plurality of conductive raisings protruding from the circumferential surface of the rotary shaft member.

A charge power supply 104 is connected to the charge brush roller 8K. Specifically, a charge bias including superimposition of an alternating current voltage and a direct current voltage having a negative polarity is applied to the charge brush roller 8K. Due to application of the bias, discharge occurs between plural raisings of the brush and a photoconductive member 3K at a contact between the charge brush roller 8K and the photoconductive member 3K, thereby the photoconductive member 3K is uniformly charged in the negative polarity.

A preparatory charge blade 9K made of metal or the like contacts the surface of the photoconductive member 3K downstream of a primary transfer nip and upstream of the contact position contacting the charge brush roller 8K. A preparatory charge power supply 105 supplies a preparatory charge bias including a direct current voltage having a negative polarity as same as toner to the preparatory charge blade 9K. The photoconductive member 3K is then charged in the negative polarity at around the contact section contacting the preparatory charge blade 9K. Simultaneously, some of reversely charged toner (i.e., positive polarity toner) included in post transfer toner is normally charged in the negative polarity due to electricity injection from the preparatory charge blade 9K.

The above-mentioned preparatory charge bias includes a negative voltage larger than a direct current component of a charge bias applied to the charge brush roller 8K. Thus, the surface of the photoconductive member 3K comes to have a negative voltage larger than the direct current component of the charge bias after the preparatory charging. When the toner moves up to the inlet of the contact position contacting the charge brush roller 8K together with the surface of the photoconductive member 3K, toner adhering to the photoconductive member 3K is taken in to the brush due to a difference in voltage between the photoconductive member 3K and the brush. When the surface of the photoconductive member 3K is uniformly charged by the charge brush roller 8K, the voltage thereof becomes less than the voltage of the brush, and the toner stays within the brush and is not transferred to the surface of the photoconductive member 3K. This is because, an adherence force of the toner adhering to the raising caused due to Van der Waals forces or a mirror image force largely works to the toner more than an electrostatic force caused due to a difference in voltage between the photoconductive member 3 and the brush. In this way, a temporal toner capturing process is executed in the first modification.

Figure 8:
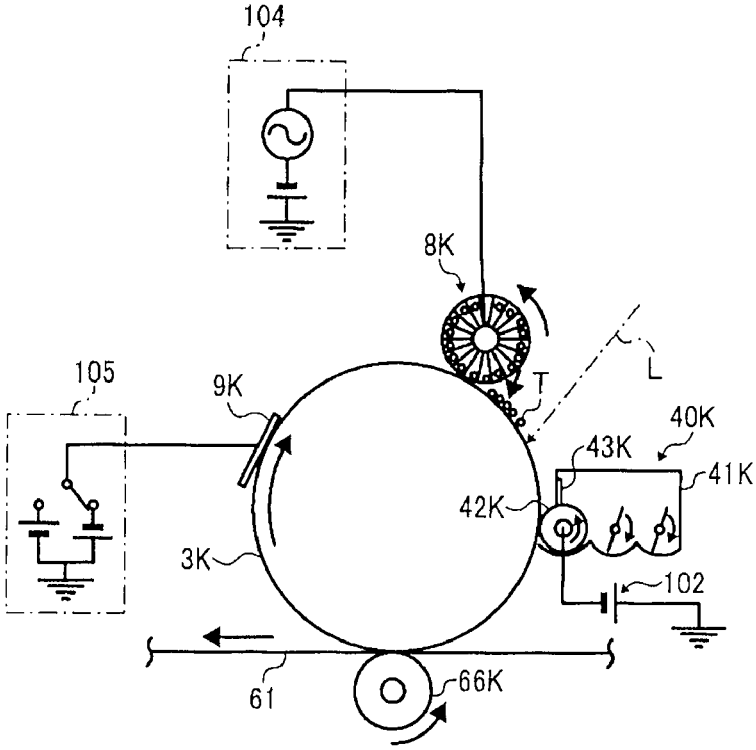
FIG. 8 illustrates the process unit of FIG. 7 in the middle of a returning process.

In the returning process, the preparatory charge bias applied from the preparatory charge power supply 105 to the preparatory charge blade 9K is switched to a direct current positive voltage as shown in FIG. 8. Thus, the surface of the photoconductive member 3K is charged to have a positive polarity. At this moment, the component of the direct current of the bias applied to the charge brush roller 8K is changed to have a negative polarity less than that applied thereto when a temporal toner capturing process is executed. The toner in the brush is attracted by the positive polarity of the surface of the photoconductive member 3K charged with the positive polarity by the preparatory charge blade 9K and moves to the inlet of the contact position. After that, even though the surface of the photoconductive member 3K is uniformly charged by the charge brush roller 8K to have about zero voltage, toner on the surface reacts the negative polarity of the direct current component of the brush, thereby staying on the surface of the photoconductive member 3K.

Figure 9:
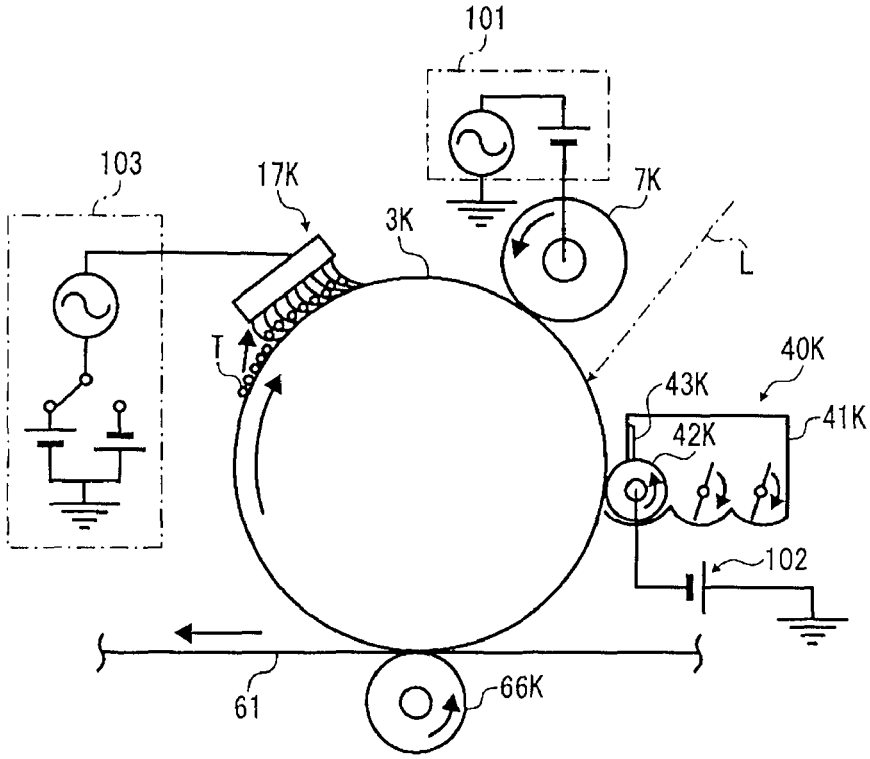
FIG. 9 illustrates an exemplary process unit for black color use as a second modification of the printer.

The second modification is now described with reference to FIG. 9. As shown, a process unit 1K includes a toner capturing brush member 17K instead of the toner capturing brush roller 15K of FIG. 2. The toner capturing brush member 17K includes a non-rotary support bracket made of metal and a brush having a plurality of raisings protruding from the surface of the supporting bracket. The toner capturing brush member 17K contacts the surface of the photoconductive member 3K via tips of the brushes.

A collection power supply 103 supplies a capturing bias including superimposition of an alternating current voltage and a direct current voltage having a positive polarity during a temporary capturing process as shown by the drawing.

Figure 10:
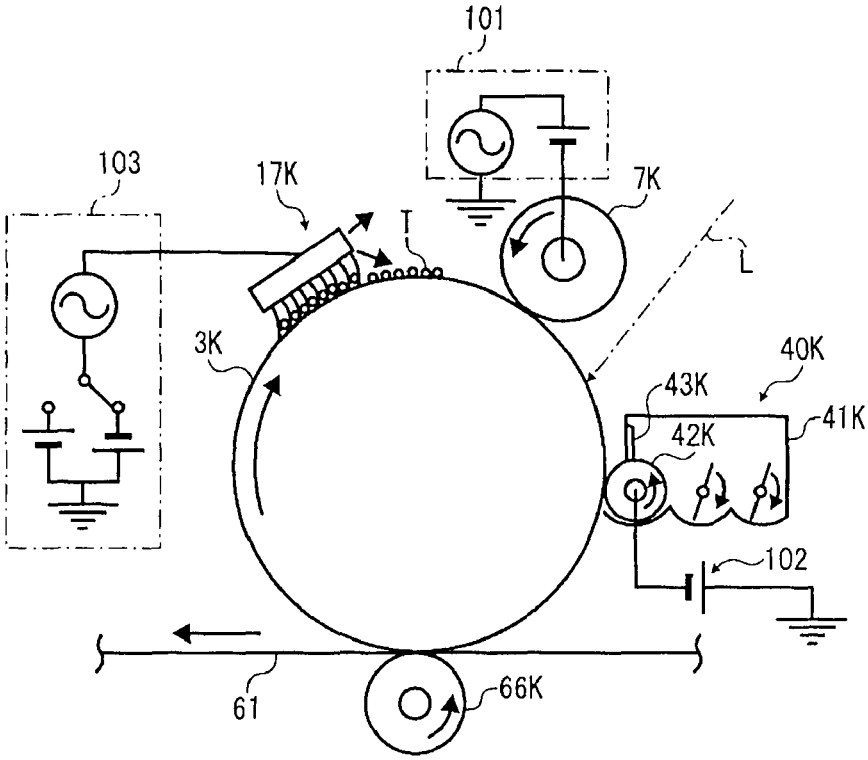
FIG. 10 illustrates the process unit of FIG. 9 in the middle of a returning process.

Thus, the collection power supply 103 causes toner on the surface to be taken in the brush. When a returning process is executed, an ejection bias including superimposition of an alternating current voltage and a direct current voltage having a negative polarity is applied to the toner capturing brush roller 15K, thereby the toner in the brush is ejected to the surface of the photoconductive member 3K as shown in FIG. 10.

Figure 11:
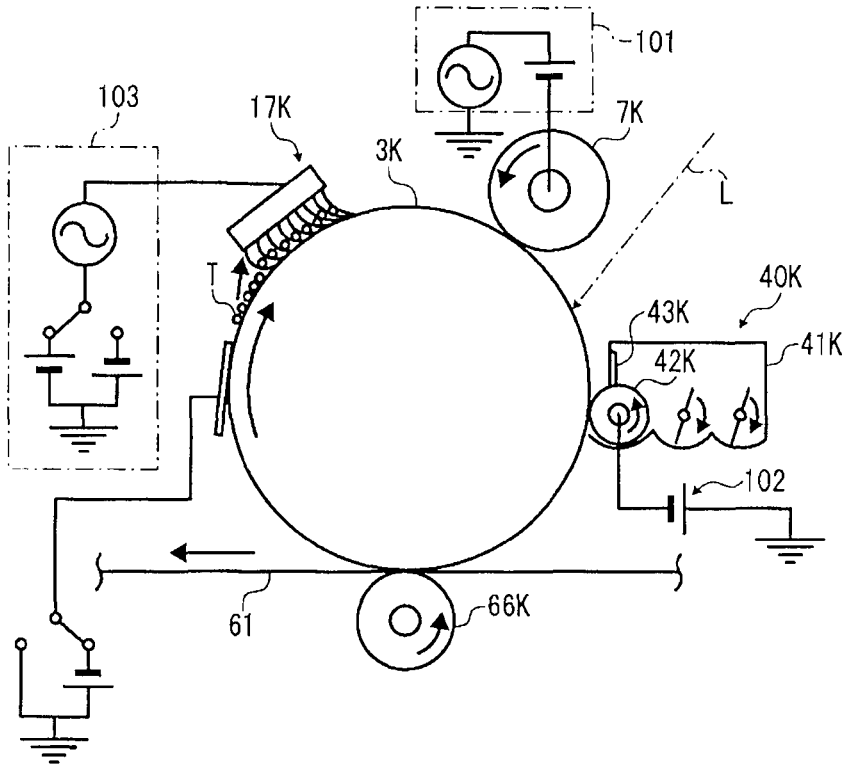
FIG. 11 illustrates an exemplary process unit for black color use as a third modification of the printer.

The third modification is now described with reference to FIG. 11. As shown, a process unit 1K includes a toner capturing brush member 17K instead of the toner capturing brush roller 15K of FIG. 2 as in the second modification. A preparatory charge blade 9K contacts the surface of the photoconductive member 3K downstream of a primary transfer nip and upstream of a contact position contacting the toner capturing brush member 17K.

When a temporal toner capturing process is executed, a preparatory charge power supply 105 supplies a preparatory charge bias including a direct current voltage having a negative polarity to the preparatory charge blade 9K as shown there. Thus, the surface of the photoconductive member 3*k* is charged in the negative polarity. At this moment, a reversely charged toner included in post transfer toner is normally charged in the negative polarity. Although the toner adhering to the surface of the photoconductive member 3K after the preparatory charge is taken in the brush of the toner capturing brush member 17K as in the second modification, due to the preparatory charge applied to the surface of the photoconductive member 3K in the negative polarity, efficiency of a toner taking in operation is higher than that in the second modification.

Figure 12:
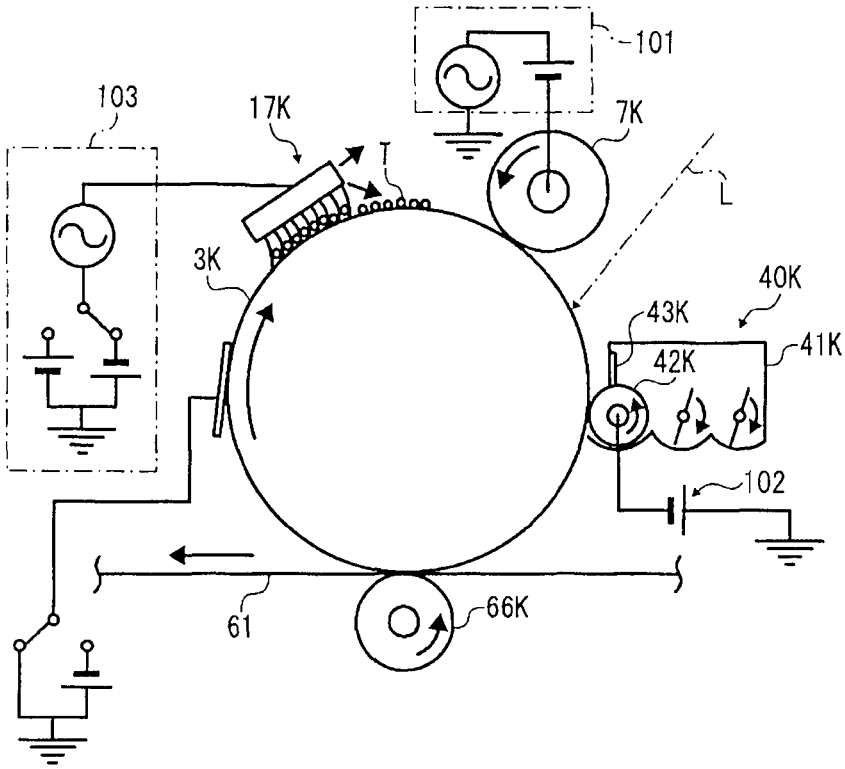
FIG. 12 illustrates the process unit of FIG. 11 in the middle of a returning process.

When a returning process is executed, the preparatory charge power source 105 connects the preparatory charge blade 9K to ground as shown in FIG. 12. The toner in the brush of the toner capturing brush member 17K is ejected to the surface of the photoconductive member 3K in the same manner as in the second modification.

Now, various printers having a unique configuration are described.

In a first embodiment, a printer employs a toner capturing brush roller 15K rotatively driven as in the earlier mentioned printers or the first modification. By changing a difference 4 in line speed between the surface of the photoconductive member 3K and the brush surface of the toner capturing brush roller 15K, a bending direction of a raising is changed from when a temporal toner capturing process is executed to when a returning process is executed.

Specifically, when the temporal toner capturing process is executed, the toner capturing brush roller 15K is rotatively driven at a constant speed so that the surface of the brush of the toner capturing brush roller 15K is moved in the same direction as the surface of the photoconductive member 3K at the same or faster speed than that of the surface of the photoconductive member 3K at the contact section contacting the photo-conductive member 3K. With such a constant rotative driving, the raising 16K of the brush is bent on the upstream side in the surface moving direction of the photoconductive member 3K as shown in FIG. 4.

When a returning process is executed, a line speed of the toner capturing brush roller 15K is changed in a relatively short cycle. Specifically, operations of slowing down the line speed of the toner capturing brush roller 15K than that of the photoconductive member 3K (or stops rotating) and speeding the line speed thereof than that of the photoconductive member 3K are repeated within a short time period. During the change in the line speed, when the line speed of the toner capturing brush roller 15K is lower than that of the photoconductive member 3K (or stops rotating), the raising 16K of the brush is bent toward the downstream as opposite to when the temporal toner capturing process is executed as shown in FIG. 5. Then, during the bending toward the opposite side, the toner in the brush is prompted to move to the photoconductive member 3K. Further, by switching the line speed of the toner capturing brush roller 15K from lower to higher level than that of the photoconductive member 3K, the bending direction of the raising 16K is returned to the same direction as in the temporal toner capturing process. As a result, movement of the toner from the brush to the photoconductive member 3K is further prompted. Thus, by repeatedly reversing the bending direct of the raising 16K within a relatively short time period, tone ejection is prompted over the entire circumference of the brush.

Figure 13:
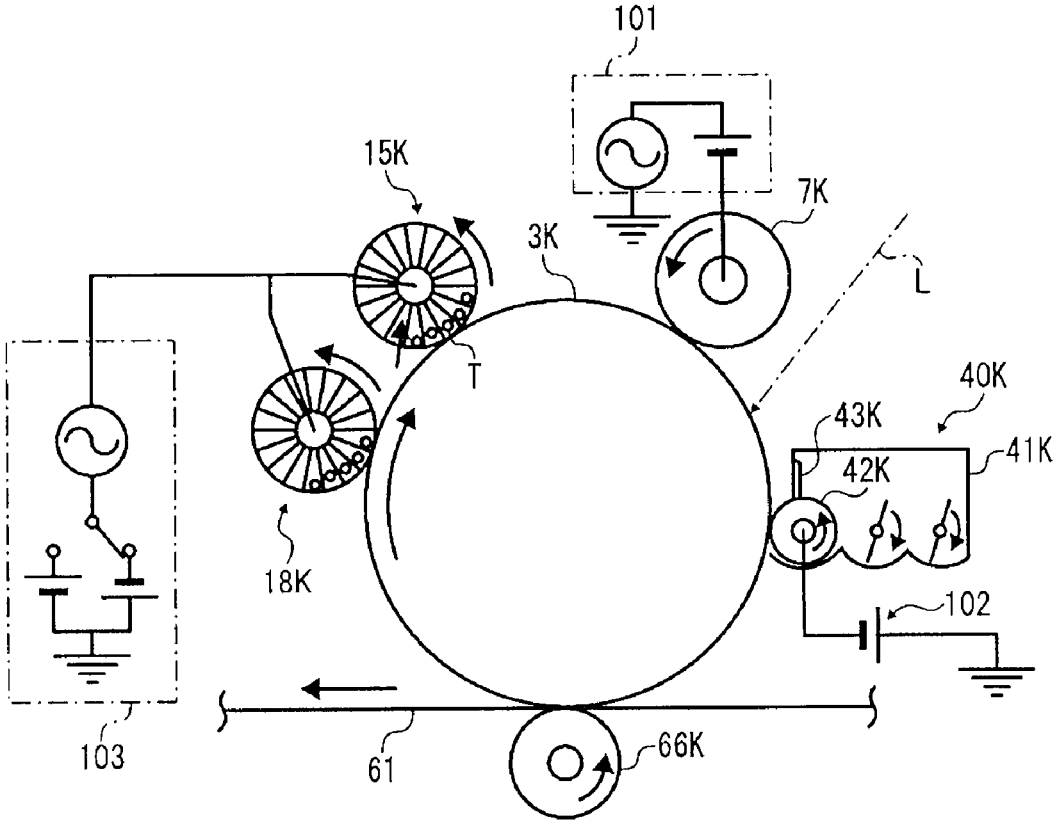
FIG. 13 illustrates another exemplary process unit for black color use arranged in a printer according to a second embodiment of the present invention.

A second embodiment is now described with reference to FIG. 13. A printer of the second embodiment employs a rotatively driven toner capturing brush roller similar to the printer of the first embodiment. By changing a difference in line speed between the surface of the photoconductive member 3K and that of the brush of the toner capturing brush roller 15K, a bending direction of the raising is changed from when the temporal toner capturing process is executed to when the returning process is executed.

A difference from the printer of the first embodiment is that this printer includes a pair of toner capturing brush rollers in one process unit. As shown in FIG. 13, the process unit 1K includes a second toner capturing brush roller 18K that rotationally contacts the surface of the photoconductive member 3K downstream of a primary transfer nip and upstream of a contact position contacting a toner capturing brush roller 15K. A density of arrangement of the raisings in the second toner capturing brush roller 18K is less than that in the toner capturing brush roller 15K. In proportion to the difference in the density, toner can be more readily ejected to the surface of the photoconductive member 3K from the brush. However, ability of temporarily capturing the toner in the brush of the brush roller 18K is inferior than that of the toner capturing brush roller 15K. However, even when there appears toner not captured by the second toner capturing brush roller 18K, the toner capturing brush roller 15K having the higher raising arrangement density can credibly capture the same. Thus, a problem of the capturing inferior is suppressed.

In such a configuration, an amount of input of toner to the toner capturing brush roller 15K is decreased, because the second toner capturing brush roller 18K having a superior toner ejection efficiency is arranged upstream of the toner capturing brush roller 15K. Thus, accumulation of toner in the toner capturing brush roller 15K is suppressed.

Figure 14:
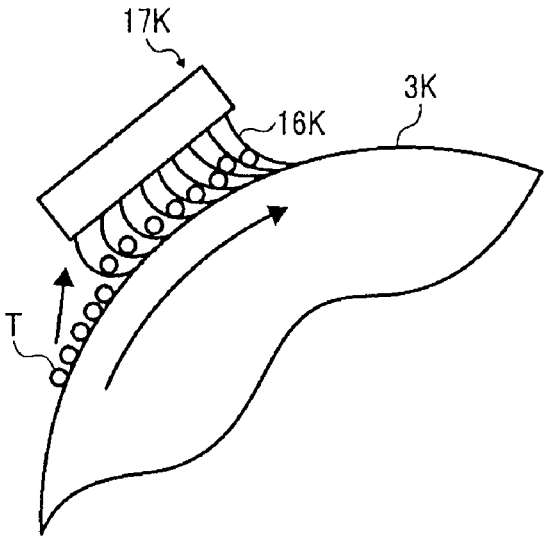
FIG. 14 illustrates an exemplary toner capturing bush member for capturing black toner and an exemplary photoconductive member contacting the toner capturing bush member arranged in a printer according to a third embodiment of the present invention.

A third embodiment is now described with reference to FIG. 14. A printer of the third embodiment employs a not rotatively driven toner capturing brush member similar to the printer of the earlier mentioned second and third modifications. As shown in FIG. 14, a black use process unit includes a brush shifting mechanism, not shown, for shifting a toner capturing brush member 17K in a direction of a tangent line of the photoconductive member 3K.

The toner capturing brush member 17K is stopping at a home position HP when a temporal toner capturing process is executed. A raising 16K is bent to the upstream of a moving direction of the surface of the photo-conductive member 3K while a tip of the raising 16K follows the movement of the surface and positions on the downstream side thereof more than the other end (i.e., root).

Figure 15:
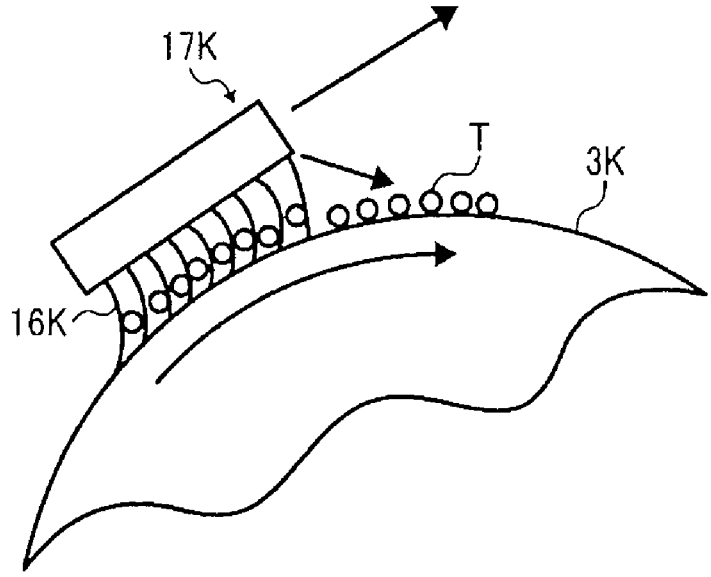
FIG. 15 illustrates an exemplary model showing the toner capturing bush member and the photoconductive member of FIG. 14 in the middle of a returning process.

When a returning process is started, the black use process unit shifts the toner capturing brush member 17K to a position KP downstream of the home position in the surface moving direction by means of the brush shifting mechanism as shown in FIG. 15. Then, the movement causes the raising 16K to be bent toward the downstream of the surface movement direction as opposite to that during the temporal toner capturing process. However, such a bent is temporal, and is reversed in a short time as the tip of the raising moves downstream following the surface movement of the photoconductive member 3. At that time, ejection of the toner is prompted. Then, the process unit returns the toner capturing brush member 17K to the home position.

Since substantially the entire region of the brush surface simultaneously contacts the photoconductive member 3K, ejection of the toner from the brush region can be promoted by reversing the direction of the bent of the raising only once. In contrast, in a rotating toner capturing brush roller, since a cylindrical brush surface partly contacts the surface of the photoconductive member 3K, rotation of the brush and reversing of the bending direction of the raising are needed plural times in order to promote the toner ejection from the cylindrical brush.

Figure 16:
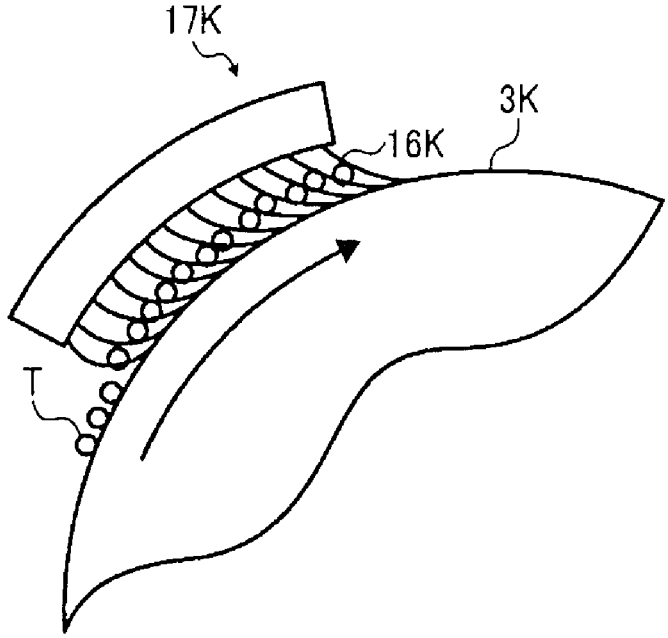
FIG. 16 illustrates an exemplary toner capturing bush member for capturing black toner and an exemplary photoconductive member contacting the toner capturing bush member arranged in a printer according to a forth embodiment of the present invention.

Now, the fourth embodiment is described with reference to FIG. 16. A printer employs a not rotatively driven toner capturing brush member similar to the printer of the third embodiment. Specifically, a bending direction of the raising is reversed by shifting the toner capturing brush member.

A difference from the third embodiment is that a brush surface of the toner capturing brush member 17K includes a curvature along the circumferential surface of the photoconductive member 3K. As apparent when compared with FIGS. 15 and 16, this configuration can improve efficiency of capturing and ejecting of toner by increasing a contact surface area between the brush surface and the photoconductive member 3K in comparison with a flat brush surface shown in FIGS. 15 and 16.

Now, the fifth embodiment is described. A printer employs one of a rotatively driven toner capturing roller and a not rotatively driven toner capturing member. A bending direction of a raising is reversed by reversely rotating the photoconductive member 3K when a returning process is executed from when a temporal toner capturing process is executed.

With such a configuration, the bending direction of the raising can be reversed without changing a rotary speed of the toner capturing brush roller nor shifting the toner capturing brush member.

Figure 17:
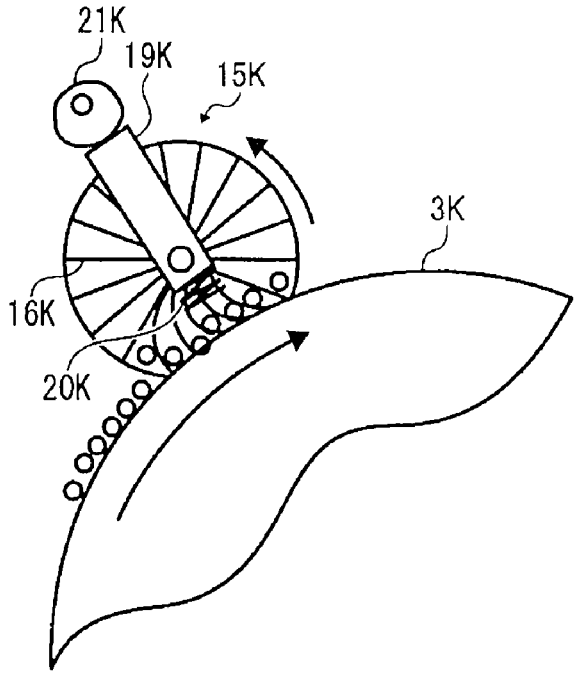
FIG. 17 illustrates an exemplary break in amount changing device provided in a printer according to a sixth embodiment of the present invention.

The sixth embodiment is now described with reference to FIG. 17. A printer employs any one of the above-mentioned first to fifth examples. In addition, a break in amount changing device is provided to change an amount of breaking of a brush member into a photoconductive member by moving the brush member in a direction perpendicular to the surface of the photoconductive member as illustrated in FIG. 17, wherein a brush member includes a black use toner capturing brush roller 15K.

As there shown, a rotary shaft member of the toner capturing brush roller 15K is freely supported by a bearing 19K. The bearing 19K is slidably held by a supporter, not shown, vertically in relation to the surface of the photoconductive member 3K. A coil spring 20K and an eccentric cum 21K driven by a driver, not shown, contact the bearing 19K from different directions from each other. When a rotary angle of the eccentric cum 21*k* changes, the bearing 19K changes its sliding stop position. Thus, the breaking in amount of the brush into the photoconductive member 3*k* changes.

When a temporal toner capturing process is executed, the break in amount is preferably set relatively larger so as to increase efficiency of toner scraping from the surface of the photoconductive member 3K. Then, the break in amount changing device set the break in amount enabling the raising to take large bending posture as shown in the drawing.

Figure 18:
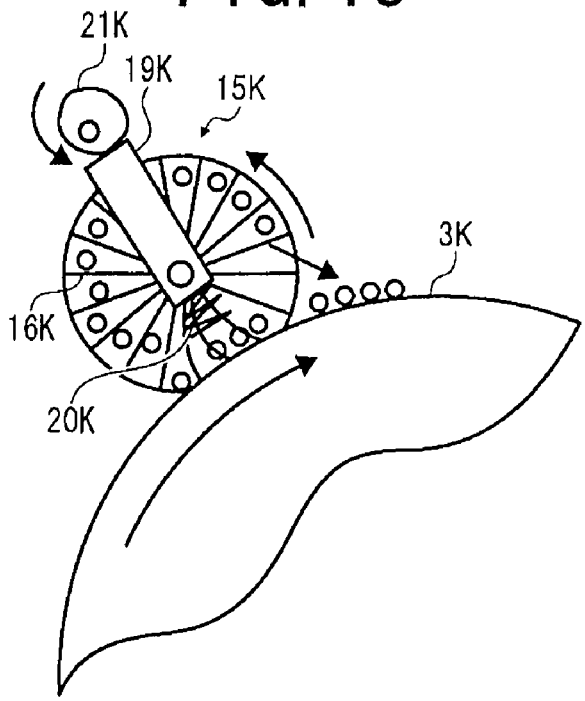
FIG. 18 illustrates the break in amount changing device of FIG. 17 in the middle of a returning process.

Whereas when the returning process is executed, the break in amount is preferably set as smaller as possible so as to decrease the bending amount in view of efficiency of toner ejection. Then, the break in amount changing device set the break in amount smaller than when the temporal toner capturing process is executed as shown in FIG. 18.

Obviously, numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus, comprising:

an image bearer moving in a prescribed direction;

a toner image formation device to form a toner image on a surface of the image bearer;

a transfer device to transfer the toner image from the surface of the image bearer onto a transfer member at a transfer station; and a brush member including at least two raisings and which contacts the surface of the image bearer downstream of the transfer station and temporarily captures toner remaining on the surface of the image bearer into the brush member during a toner capturing process, said brush member returning the toner to the surface of the image bearer at a later prescribed time during a toner returning process, wherein a bending direction of the at least two raisings during the returning process is opposite to a bending direction of the at least two raisings during the toner capturing process.

2. The image forming apparatus as claimed in claim 1, further comprising:

an electric field direction changing device to change a direction of an electric field created between the brush member and the image bearer, wherein the capturing process is switched to the returning process in accordance with the direction of the electric field.

3. The image forming apparatus as claimed in claim 2, wherein said electric field direction changing device creates an alternating electric field during the returning process.

4. The image forming apparatus as claimed in claim 1, wherein the returning process is executed when a blank region of the surface of the image bearer passes through the brush member.

5. The image forming apparatus as claimed in claim 1, wherein said brush member includes:

a rotary shaft member rotatively supported by a supporting member;

a brush roller having the at least two raisings around an outer circumferential surface thereof; and a driving member to drive the brush roller.

6. The image forming apparatus as claim in claim 5, wherein said bending direction of the at least two raisings is changed by changing a difference between a line speed of the image bearer and a line speed of the brush member when the returning process is executed from when the toner capturing process is executed.

7. The image forming apparatus as claimed in claim 5, wherein said returning process is executed while the brush roller is driven at a line speed equal to less than a half of a surface moving speed of the image bearer.

8. The image forming apparatus as claimed in claim 1, wherein said brush member includes a flat supporting member, and wherein said at least two raisings protrude from the surface of the flat supporting member.

9. The image forming apparatus as claimed in claim 8, further comprising a brush shifting device configured to shift the brush member, wherein said bending direction of the at least two raisings is changed by shifting the brush member located at an original position in a prescribed direction when the returning process is executed, wherein said the brush member is located at the original position when the temporal toner capturing process is executed.

10. The image forming apparatus as claimed in claim 8, wherein the surface of said image bearer moves along a circular arc orbit at a contact with the brush member, and wherein said at least two raisings bend along the circular arc orbit.

11. The image forming apparatus as claimed in claim 1, wherein the bending direction of the raising during the returning process is changed from the bending direction during the toner capturing process by moving the surface of the image bearer in a direction opposite to a direction during the toner capturing process.

12. The image forming apparatus as claimed in claim 1, further comprising:

a break in amount changing device to change an amount of breaking in of the brush member to the image bearer, wherein the amount is increased more when the returning process is executed than when the toner capturing process is executed.

13. An image forming apparatus, comprising:

an image bearer moving in a prescribed direction;

a toner image formation device to form a toner image on a surface of the image bearer;

a transfer device to transfer the toner image from the surface of the image bearer onto a transfer member at a transfer station; and a brush member including at least two raisings and which contacts the surface of the image bearer downstream of the transfer station and temporarily captures toner remaining on the surface of the image bearer into the brush member during a toner capturing process, said brush member returning the toner to the surface of the image bearer at a later prescribed time during a toner returning process, wherein a bending direction of the at least two raisings during the returning process is opposite of a bending direction of the at least two raisings during the toner capturing process, and said bending direction of the at least two raisings is changed by changing a difference between a line speed of the image bearer and a line speed of the brush member when the returning process is executed from when the temporal toner capturing process is executed.

14. An image forming apparatus, comprising:

an image bearer moving in a prescribed direction;

a toner image formation device to form a toner image on a surface of the image bearer;

a transfer device to transfer the toner image from the surface of the image bearer onto a transfer member at a transfer station; and a brush member including at least two raisings and which contacts the surface of the image bearer downstream of the transfer station and temporarily captures toner remaining on the surface of the image bearer into the brush member during a toner capturing process, said brush member returning the toner to the surface of the image bearer at a later prescribed time during a toner returning process, wherein a bending direction of the at least two raisings during the returning process is opposite of a bending direction of the at least two raisings during the toner capturing process, and the bending direction of the raising during the returning process is changed from the bending direction during the toner capturing process by moving the surface of the image bearer in a direction opposite to a direction during the toner capturing process.

* * * * *